US007980676B2

(12) United States Patent
Hirosawa et al.

(10) Patent No.: US 7,980,676 B2
(45) Date of Patent: Jul. 19, 2011

(54) LIQUID EJECTION HEAD INCLUDING MEMBER SUPPORTING LIQUID EJECTION SUBSTRATE

(75) Inventors: Toshiaki Hirosawa, Hiratsuka (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 365 days.

(21) Appl. No.: 12/145,705

(22) Filed: Jun. 25, 2008

(65) Prior Publication Data

US 2009/0179965 A1 Jul. 16, 2009

(30) Foreign Application Priority Data

Jun. 27, 2007 (JP) ..... 2007-168893

(51) Int. Cl.
*B41J 2/05* (2006.01)

(52) U.S. Cl. ..... 347/65; 347/63; 347/44

(58) Field of Classification Search ..... 347/20, 347/44, 47, 49, 50, 56–59, 61–65, 67, 84–86
See application file for complete search history.

(56) References Cited

U.S. PATENT DOCUMENTS

| | | | | |
|---|---|---|---|---|
| 6,123,410 | A | 9/2000 | Beerling et al. | |
| 6,257,703 | B1 * | 7/2001 | Hirosawa et al. | 347/50 |
| 6,325,488 | B1 | 12/2001 | Beerling et al. | |
| 6,652,702 | B2 | 11/2003 | Miyazaki et al. | |
| 6,659,591 | B2 | 12/2003 | Sato et al. | |
| 6,910,759 | B2 | 6/2005 | Kawamura et al. | |
| 2007/0139469 | A1 | 6/2007 | Yasuda et al. | |
| 2007/0242101 | A1 | 10/2007 | Hirosawa et al. | |
| 2007/0242102 | A1 | 10/2007 | Hirosawa et al. | |
| 2009/0267994 | A1 | 10/2009 | Suganuma et al. | |

FOREIGN PATENT DOCUMENTS

| | | |
|---|---|---|
| JP | 10-44420 | 2/1998 |
| JP | 11-138814 | 5/1999 |
| JP | 11-192705 | 7/1999 |
| JP | 2006-321222 | 11/2006 |
| WO | WO 2006/112526 | 10/2006 |

* cited by examiner

*Primary Examiner* — Juanita D Stephens
(74) *Attorney, Agent, or Firm* — Fitzpatrick, Cella, Harper & Scinto

(57) ABSTRACT

A liquid ejection head is constituted by a liquid ejection substrate comprising a liquid supply port for supplying liquid, an ejection outlet for ejecting the liquid supplied from the liquid supply port, and ejection energy generating devices for generating energy for ejecting the liquid; and a supporting member having a supporting surface for supporting the liquid ejection substrate and a liquid supply hole for supplying liquid to the liquid ejection substrate, the liquid supply hole communicating with the liquid supply port of the liquid ejection substrate to form a communicating portion, a periphery of which is sealed by a sealant. The liquid supply hole of the supporting member has an opening larger than that of the liquid supply port of the liquid ejection substrate. The support member has an inner wall portion including an edge line portion defined by the liquid supply hole on a side where the liquid ejection substrate is to be disposed. The inner wall portion is covered with the sealant.

2 Claims, 16 Drawing Sheets

LIQUID EJECTION HEAD INCLUDING MEMBER SUPPORTING LIQUID EJECTION SUBSTRATE

FIELD OF THE INVENTION AND RELATED ART

The present invention relates to a liquid ejection head for ejecting liquid from an ejection outlet.

As a liquid ejection head, an ink jet head for ejecting ink droplets by utilizing energy generating by an electrothermal transducer element has been known.

In the ink jet head of this type, as shown in FIGS. 22 and 23, a silicon-made liquid ejection substrate 100 is mounted on a supporting member 10 formed of a resin material or a ceramic material to be integrated. The liquid ejection substrate 100 includes ejection outlets 107 through which ink droplets are to be ejected, liquid chambers 109 for temporarily retaining the ink droplets (ink) ejected from the ejection outlets 107, liquid supply ports 102 communicating with the liquid chambers 109, and electrothermal transducer elements 103 for supplying ejection energy to the ink in the liquid chambers 109.

More specifically, a back surface of the liquid ejection substrate 100 (a surface on a side where the liquid ejection substrate 100 is to be supported by the supporting member 10) and a surface of the supporting member 10 are bonded through an adhesive material 50. Further, through an ink flow passage formed by opposing interfaces of adjacent adhesive material portions 50, each liquid supply port 102 of the liquid ejection substrate 100 communicates with an associated liquid supply hole 11 provided in the supporting member 10. Such a constitution is described in Japanese Laid-Open Patent Application (JP-A) Hei 10-44420, JP-A Hei 11-138814, JP-A 2006-321222, etc.

Further, JP-A Hei 11-192705 discloses, as shown in FIG. 24, such a constitution that a surface electrode terminal 202 of an electric wiring layer formed on a surface of a supporting member 200 is bonded to an electrode layer formed on a back surface of a liquid ejection substrate 100 by using a bump 105 or the like to establish electrical connection.

In recent years, a lowering in price of an ink jet recording apparatus is noticeable, so that there arises a problem of how to prepare an ink jet head inexpensively. The liquid ejection substrate is generally used in a cut state with a necessary size after liquid ejection energy generating elements and liquid flow passages are formed on a silicon wafer having a diameter of about 6 to 8 inches, so that downsizing of the liquid ejection substrate itself is required in order to realize low cost. Further, there is a tendency that the liquid ejection substrate is elongated due to increases in the number of ejection outlets constituting an ejection outlet array and in the number of the liquid ejection energy generating elements in order to realize a high recording speed and an improvement in recording quality. Accordingly, the trend of the liquid ejection substrate is shifting toward the elongation, narrowing, and downsizing. In addition, reduction in number of constituent members and steps for supplying a recording liquid to the liquid ejection substrate is also effected.

However, when a constitution in which the liquid ejection substrate is elongated and narrowed is employed, the above-described ink jet head has been accompanied with the following problems such that it causes leakage of the liquid (ink) from the liquid supply passages or electrical connection failure due to corrosion of an electrical connecting portion.

1) Lowering in Adhesive Reliability Between Liquid Ejection Substrate and Supporting Member As shown in FIG. 23, the liquid ejection substrate 100 is bonded to the supporting member 10 provided with the liquid supply hole 11, so that it is necessary to ensure adhesive reliability between the liquid ejection substrate 100 and the supporting member (i.e., cause no leakage of the liquid). For that purpose, ensuring of material selection and adhesive area of the adhesive material 50, i.e., a size of the liquid ejection substrate 100 and a shape of an edge line portion of an opening of the liquid supply hole of the supporting member 10, are important factors.

More specifically, as the supporting member 10, molded parts of a resin material or a ceramic material are generally used. In these cases, in order to ensure adhesive reliability with respect to the liquid ejection substrate 100 and a performance of the supporting member 10, as the supporting member 10, an inexpensive material which is not damaged by a recording liquid and is capable of having a low thermal expansion coefficience and a high thermal conductivity and ensuring high flatness of an adhesive surface is used.

In the case where the supporting member 10 is formed of the resin material, a resin material which contains a filler and has a relatively poor flowability is frequently selected. Accordingly, when an edge line portion of an opening of the liquid supply hole 11 of the supporting member 10 is noted, as shown in FIG. 25A, a shape of an edge line portion 15 of the liquid ejection head 11 is not a right-angle edge shape but is a moderate R-like shape 16 due to insufficient filling of the resin material in some cases. Further, as shown in FIG. 25B, an edge defect 17 can occur at a part of the edge line portion.

On the other hand, in the case where the supporting member 10 is a burned product of a ceramic material, due to contraction of the burned product during burning, it is difficult to ensure flatness of an adhesive surface for adhering the liquid ejection substrate 100, so that the burned product is generally surface-polished for use after the burning. For this reason, when the edge line portion of the liquid supply hole 11 of the supporting member 10 is noted, as shown in FIG. 25B, the edge defect 17 can occur at a part of the edge line portion 15 of the liquid supply hole 11.

As described above, as shown in FIG. 26, particularly, in the case where a plurality of liquid supply ports 102 is disposed relatively adjacent to each other, at a portion where the shape of the edge line portion 15 of the liquid supply hole 11 of the supporting member 10 is irregular, an adhesive area between the liquid ejection substrate 100 and the supporting member 10 is narrowed. In FIG. 26, this is clear from an R-like shaped portion shown in an area I and an edge defect portion shown in an area J. For example, the plurality of liquid supply ports 102 of the liquid ejection substrate 100 is disposed adjacent to each other with a spacing of 1 mm. In this case, assuming that the liquid supply hole 11 of the supporting member 10 has a width of about 0.3 mm and that the R-like shape 16 of the edge line portion 15 of the liquid supply hole 11 has a radius of about 0.2 mm, a resultant adhesive width is not more than half an original adhesive width. Therefore, there is a possibility that adhesive reliability of this portion is lowered.

2) Lowering in Reliability of Protection of Electric Wiring from Recording Liquid In such a constitution that electrical connection between the back surface of the liquid ejection substrate 100 and the front surface of the supporting member 200 shown in FIG. 24 is effected by the medium of the bump 105 or the like, the liquid supply port 102 provided in the liquid ejection substrate 100 comes very close to an electrical connecting member (bump 105). Further, the bump 105 also comes very close to the liquid supply hole 210 provided in the supporting member 200 for supporting the liquid ejection substrate 100. Accordingly, it is necessary to completely isolate the electrical connecting member from liquid for ejection, but it is very difficult to ensure an adhesive sealing area.

SUMMARY OF THE INVENTION

A principal object of the present invention is to provide a liquid ejection head capable of improving adhesive reliability thereof with a supporting member for a liquid ejection substrate, reliability of electric wiring protection from liquid, and a liquid supply performance and capable of reducing a production cost.

Another object of the present invention is to provide a liquid ejection head capable of realizing connection with very high reliability with respect to ink leakage, corrosion of an electrical connecting portion, and the like when the liquid ejection substrate is adhesively fixed and disposed on the supporting member.

According to an aspect of the present invention, there is provided a liquid ejection head comprising:

a liquid ejection substrate comprising a liquid supply port for supplying liquid, an ejection outlet for ejecting the liquid supplied from the liquid supply port, and ejection energy generating means for generating energy for ejecting the liquid; and a supporting member having a supporting surface for supporting the liquid ejection substrate and a liquid supply hole for supplying liquid to the liquid ejection substrate, the liquid supply hole communicating with the liquid supply port of the liquid ejection substrate to form a communicating portion, a periphery of which is sealed by a sealant, wherein the liquid supply hole of the supporting member has an opening larger than that of the liquid supply port of the liquid ejection substrate, and wherein the support member has an inner wall portion including an edge line portion defined by the liquid supply hole on a side where the liquid ejection substrate is to be disposed, the inner wall portion being covered with the sealant.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 5A and 5B are schematic views each showing a connection structure of the liquid ejection substrate and a supporting member in Embodiment 1 of the present invention, wherein FIG. 5A is a sectional view taken along B-B line in FIG. 4 and FIG. 5B is a sectional view taken along C-C line in FIG. 4.

FIGS. 11A and 11B are schematic sectional views each showing a connection structure of the liquid ejection substrate and the three-dimensionally wired supporting member in Embodiment 2 of the present invention, wherein FIG. 11A is a widthwise sectional view and FIG. 11B is a longitudinal sectional view.

FIGS. 12A, 12B, 13, 14A and 14B are schematic sectional views each showing another connection structure of the liquid ejection substrate and the three-dimensionally wired supporting member in Embodiment 2 of the present invention, wherein FIGS. 12A, 13 and 14A are widthwise sectional views and FIGS. 12B and 14B are longitudinal sectional views.

FIGS. 15A and 15B are schematic sectional views each showing a connection structure of a liquid ejection substrate and a three-dimensionally wired supporting member in Embodiment 3 of the present invention, wherein FIG. 15A is a widthwise sectional view and FIG. 15B is a longitudinal sectional view.

FIGS. 16, 17A, 17B and 18 are schematic sectional views each showing another connection structure of the liquid ejection substrate and the three-dimensionally wired supporting member in Embodiment 3 of the present invention, wherein FIGS. 16, 17A and 18 are widthwise sectional views and FIG. 17B is a longitudinal sectional view.

FIGS. 20A and 20B are schematic views each showing a connection structure of the liquid ejection substrate and the supporting member in Embodiment 3 of the present invention, wherein FIG. 20A is a sectional view taken along G-G line in FIG. 19 and FIG. 20B is a sectional view taken along H-H line in FIG. 19.

DETAILED DESCRIPTION OF THE PREFERRED EMBODIMENTS

Hereinbelow, embodiments of the present invention will be described with reference to the drawings.

Embodiment 1

Figure 1:
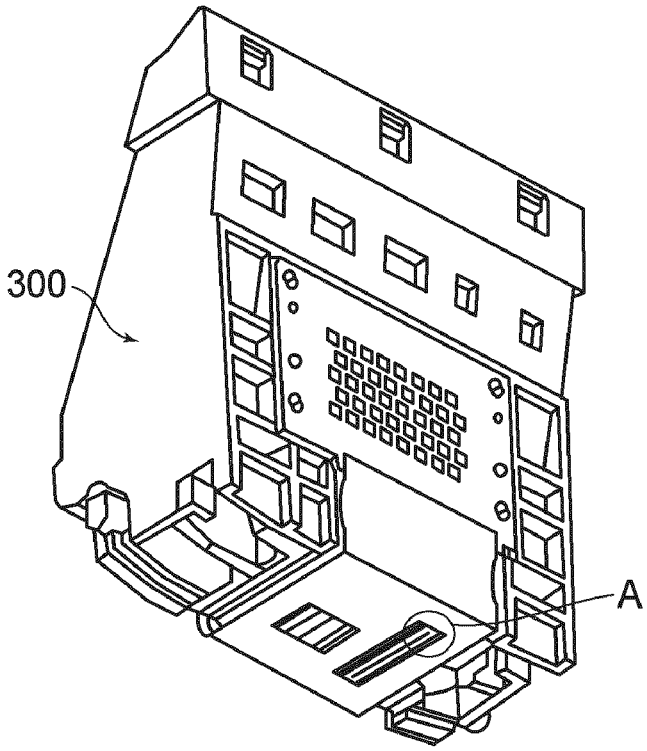
FIG. 1 is a perspective view of an outer appearance of an ink jet head according to Embodiment 1 of the present invention.
Figure 2:
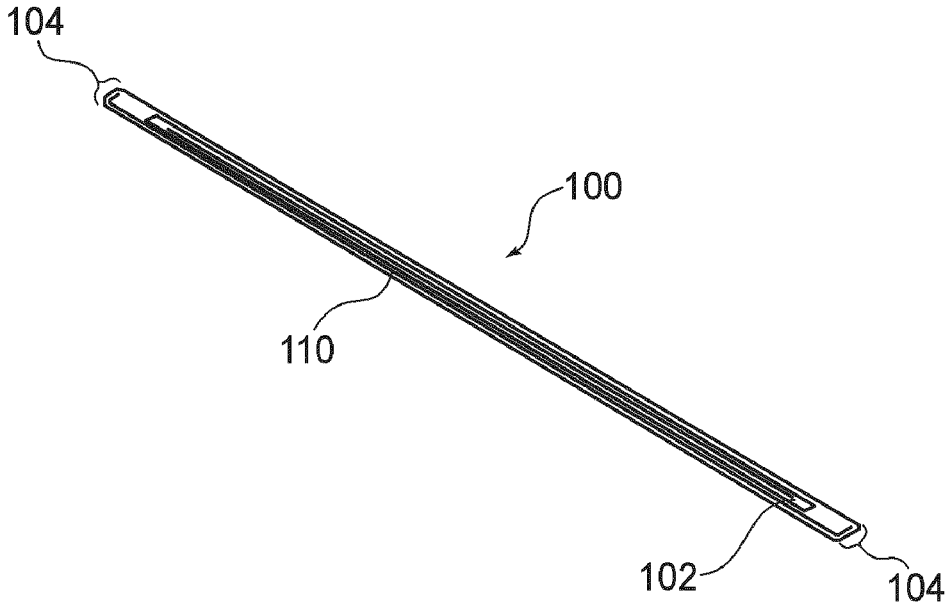
FIG. 2 is a schematic perspective view of a liquid ejection substrate used in the ink jet head shown in FIG. 1.
Figure 3:
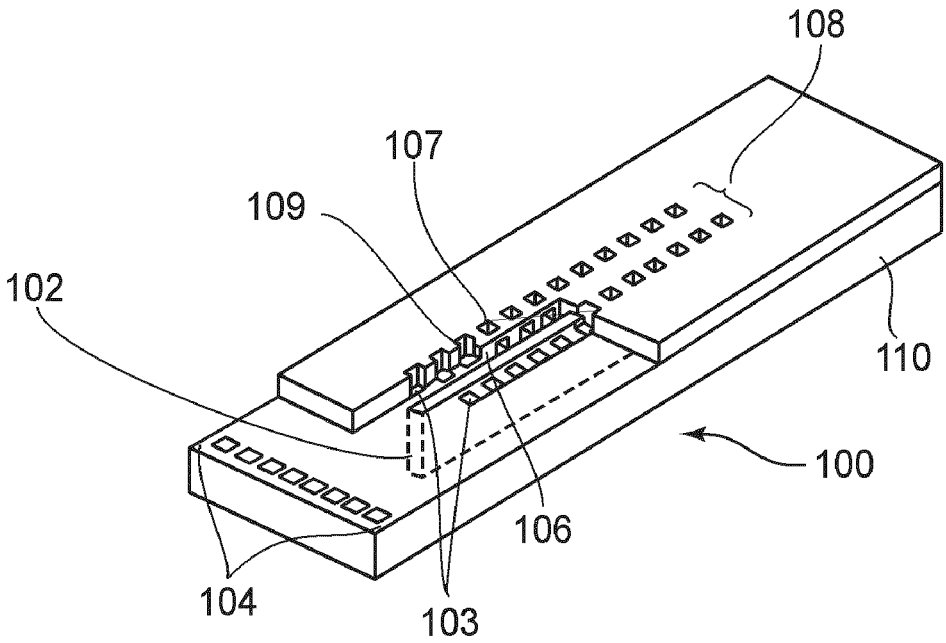
FIG. 3 is a partly enlarged perspective view of the liquid ejection substrate shown in FIG. 2.
Figure 4:
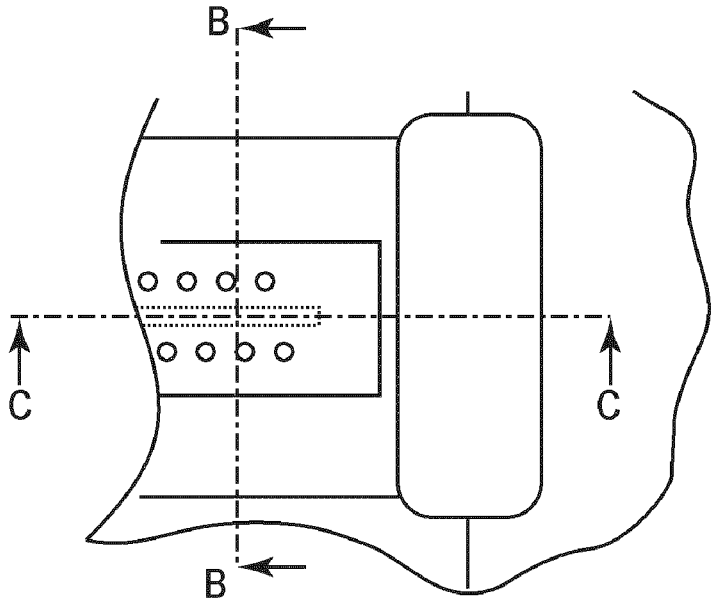
FIG. 4 is an enlarged schematic view of portion A in FIG. 1.
Figure 5A:
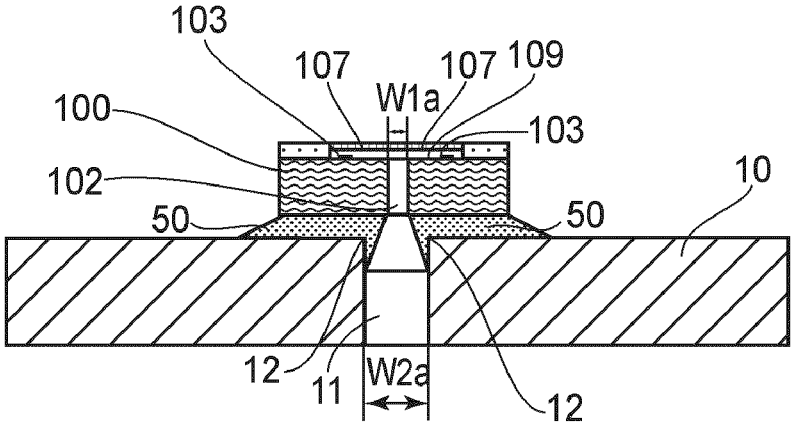
Figure 5B:
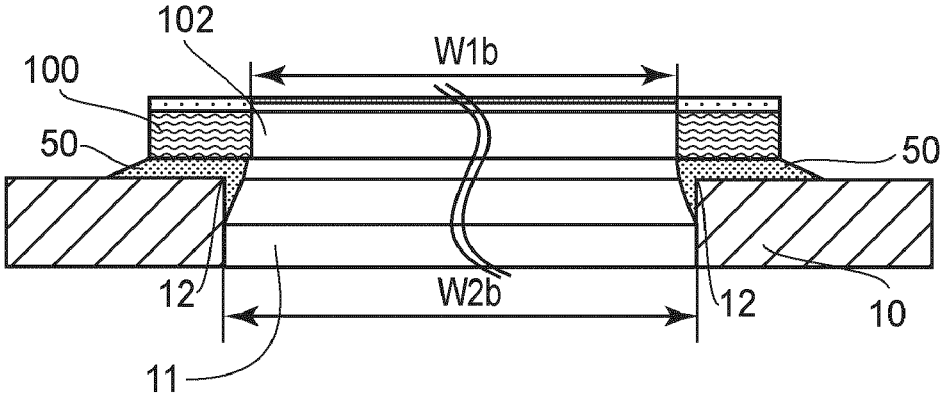

FIG. 1 is a perspective view of an outer appearance of an ink jet head according to Embodiment 1 of the present invention. FIG. 2 is a schematic perspective view of a liquid ejection substrate used in the ink jet head shown in FIG. 1. FIG. 3 is a partly enlarged perspective view of the liquid ejection substrate shown in FIG. 2. FIG. 4 is an enlarged schematic view of portion A in FIG. 1. FIGS. 5A and 5B are schematic views each showing a cross-section of a supporting member in the neighborhood of a liquid supply hole for supplying a recording liquid as an example of liquid to be supplied to a liquid ejection substrate, wherein FIG. 5A is a sectional view taken along B-B line in FIG. 4 and FIG. 5B is a sectional view taken along C-C line in FIG. 4.

The ink jet head according to this embodiment includes, as shown in FIGS. 1-5, a supporting member 10 and a liquid ejection substrate 100 mounted on the supporting member 10. Further, a recording liquid supply member 300 is connected to the supporting member 10 on a side opposite from the side where the liquid ejection substrate 100 is mounted.

This ink jet head is fixed and supported by a positioning means and electrical contacts provided to a carriage mounted in a main assembly of an ink jet recording apparatus. Further, the ink jet head is movable in a direction crossing a conveyance direction of a recording sheet.

On a surface of the liquid ejection substrate 100, as shown in FIG. 3, ejection outlets 107 for ejecting a recording liquid such as ink or the like which is liquid are opened. These ejection outlets are arranged in lines to form pluralities of ejection outlet arrays 108. On a back surface side of the liquid ejection substrate 100, liquid supply ports 102 for supplying the recording liquid are opened with the substantially same length as that of the ejection outlet arrays 108. The recording liquid supplied from the liquid supply ports 102 enters a bubble generating chamber 109 (liquid chamber) to generate bubbles by heat energy (ejection energy) produced by electrothermal transducer elements 103 as an ejection energy generating means, thus being ejected from the ejection outlets 107 as recording liquid droplets. At an end portion of the liquid ejection substrate 100, a plurality of electrodes 104 for sending an electrical signal to the electrothermal transducer elements 103 and the like is formed and connected to leads of a wiring member. This electrical connecting portion is sealed up with a sealant (not shown), thus being protected from corrosion by the recording liquid and impact.

Further, as shown in FIGS. 5A and 5B, on the back surface side of the liquid ejection substrate 100, the supporting member 10 formed of a resin material or a ceramic material is disposed and provided with a liquid supply hole 11 penetrating the supporting member 10 from the front surface to the back surface of the supporting member 10. The liquid supply ports 102 of the liquid ejection substrate 100 and the liquid supply hole 11 of the supporting member 10 are positioned so as to communicate with each other. Around a connecting portion of the liquid supply ports 102 and the liquid supply hole 11, the liquid ejection substrate 100 is adhesively fixed on the supporting member 10 with an adhesive material 50 (or a sealant).

In such an ink jet head, the recording liquid is supplied from an unshown ink supply source to the liquid supply ports 102 of the liquid ejection substrate 100 through the liquid supply hole 11 of the supporting member 10 and then to the bubble generating chamber 109 of the liquid ejection substrate 100.

Next, features of this embodiment will be described.

As shown in FIG. 5A and FIG. 5B, when a widthwise hole width of the liquid supply port 102 of the liquid ejection substrate 100 is W1*a*, a longitudinal hole width (hole length) of the liquid supply port 102 of the liquid ejection substrate is W1*b*, a widthwise hole width of the liquid supply hole 11 of the supporting member 11 is W2*a*, and a longitudinal hole width (hole length) of the liquid supply hole 11 of the supporting member 10 is Wb2, these hole widths satisfy the following relationships:

$$W1a<W2a \text{ and } W1b<W2b.$$

The liquid ejection substrate 100 is disposed on the supporting member 10 onto which a predetermined amount of the adhesive material 50 is applied in a predetermined position, and is thereafter fixed on the supporting member 10 by hardening the adhesive material 50. In this case, the adhesive material 50 extends between the liquid ejection substrate 100 and the supporting member 10 and reaches a portion of the liquid supply port 102 of the liquid ejection substrate 100 and a portion of the liquid supply hole 11 of the supporting member 10. For example, the widthwise hole width W1*a* of the liquid supply port 102 of the liquid ejection substrate 100 is taken as 60 μm, the longitudinal hole width W1*b* of the liquid supply port 102 of the liquid ejection substrate 100 is taken as 25 mm, the widthwise hole width W2*a* of the liquid supply hole 11 of the supporting member 10 is taken as 200 μm, and the longitudinal hole width W2*b* of the liquid supply hole 11 of the supporting member 10 is taken as 25.3 mm. In addition, when a spacing (gap) between the liquid ejection substrate 100 and the supporting member is taken as about 20 μm, a viscosity of the adhesive material 50 is taken as about 100 Pa·s, and a thixotropic ratio is taken as about 1.1, a good result is obtained. In this case, the adhesive material 50 extends between the liquid ejection substrate 100 and the supporting member 10 and reaches an edge line portion of the liquid supply port 102 on the liquid ejection substrate 100 side. The adhesive material 50 remains at the edge line portion by a meniscus force formed by the viscosity of the adhesive material 50 itself and the gap between the liquid ejection substrate 100 and the supporting member 10. Further, in this embodiment, an opening dimension of the liquid supply port 102 of the liquid ejection substrate 100 is smaller than that of the liquid supply hole 11 of the supporting member 10, and the edge line portion of the liquid supply port 102 extends to and reaches an inner wall of the supporting member 10 defining the liquid supply hole 11. When the adhesive material 50 is further injected into the gap between the liquid ejection substrate 100 and the supporting member 10, the adhesive material 50 on the supporting member 10 side passes through an edge line portion 12 of the liquid supply hole 11 and reaches an inner wall surface of the liquid supply hole 11. That is, the adhesive material 50 between the liquid ejection substrate 100 and the supporting member 10 remains while forming a meniscus connecting the liquid supply port 102 to the inner wall surface of the liquid supply hole 11. Thus, the adhesive material 50 on the supporting member 10 has a shape such that it covers the edge line portion 12 of the liquid supply hole 11 and the inner wall surface of the liquid supply hole 11 as shown in FIGS. 5A and 5B.

Figure 6:
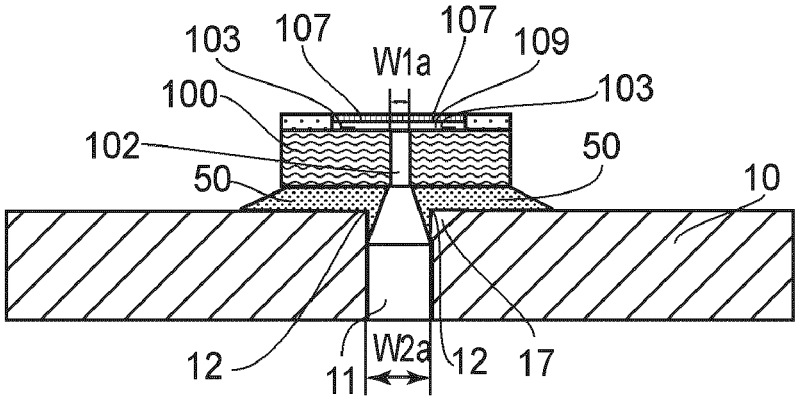
FIG. 6 is a schematic view showing a connection structure of the liquid ejection substrate and a supporting member in Embodiment 1 of the present invention taken along B-B line in FIG. 4, wherein an edge line portion of a liquid supply hole of the liquid ejection substrate has a defective edge portion.

Therefore, as shown in FIG. 6, even when the edge line portion 12 of the liquid supply hole 11 of the supporting member 10 has a defective shape to result in an edge defect portion 17 or the like, the edge defect portion is completely covered with the adhesive material 50. As a result, an adhesive area in the neighborhood of the liquid supply hole 11 of the supporting member 10 is not narrowed and the inner wall surface of the liquid supply hole 11 is also used as the adhesive area, so that a sufficient adhesive area can be obtained. In the case where the liquid ejection substrate 100 is narrowed and downsized, an adhesive area between the liquid ejection substrate 100 and the supporting member 10 is considerably decreased in general, so that it is difficult to ensure adhesive reliability. However, in this embodiment, as described above, the adhesive reliability between the liquid ejection substrate 100 and the supporting member 10 can be ensured sufficiently.

Embodiment 2

Figure 7:
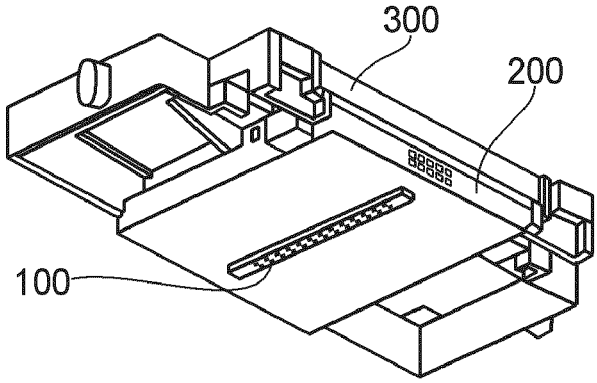
FIG. 7 is a perspective view of an outer appearance of an ink jet head according to Embodiment 2 of the present invention.
Figure 8:
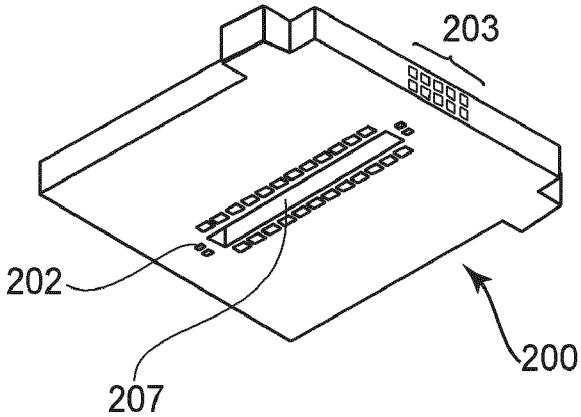
FIG. 8 is a perspective view of an outer appearance of a three-dimensionally wired supporting member shown in FIG. 7.
Figure 9:
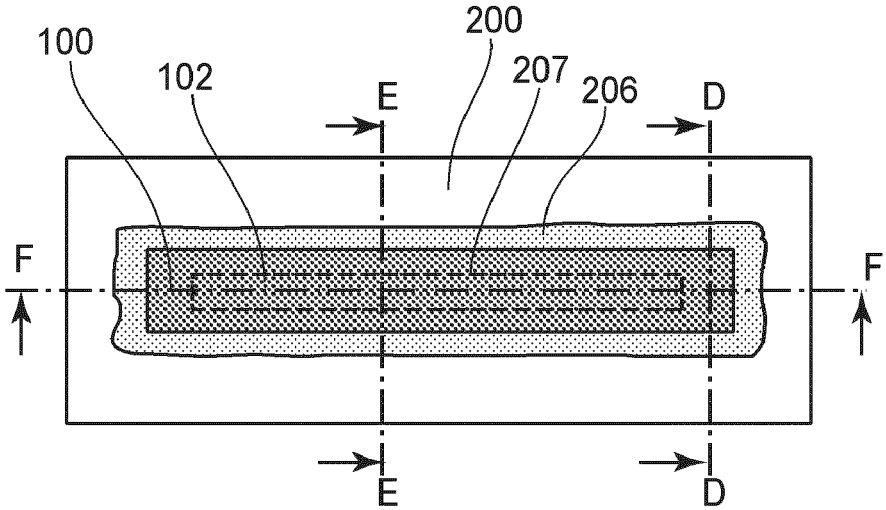
FIG. 9 is a plan view of an outer appearance showing a state in which the liquid ejection substrate of FIG. 2 is mounted on the three-dimensionally wired supporting member of FIG. 7.
Figure 10:
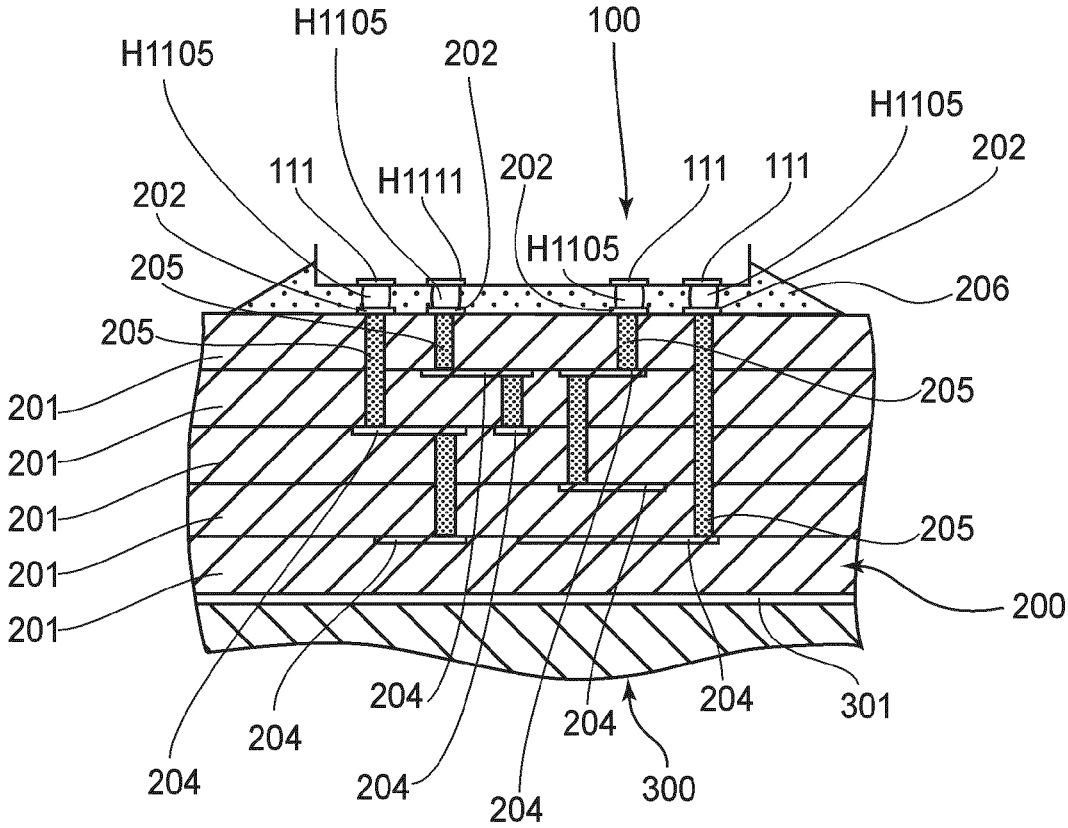
FIG. 10 is a schematic view showing a connection structure of the liquid ejection substrate and the three-dimensionally wired supporting member in Embodiment 2 of the present invention, taken along D-D line in FIG. 9.
Figure 11A:
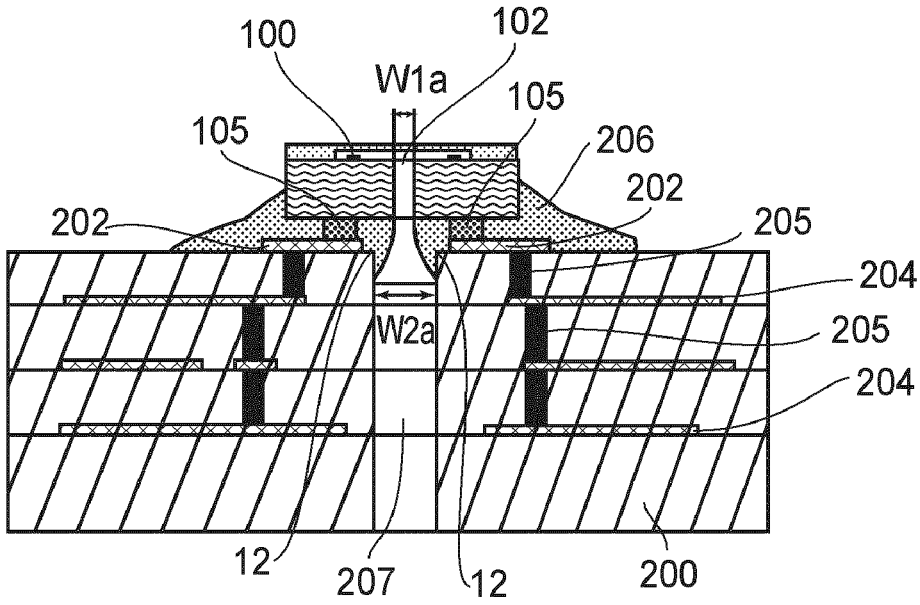
Figure 11B:
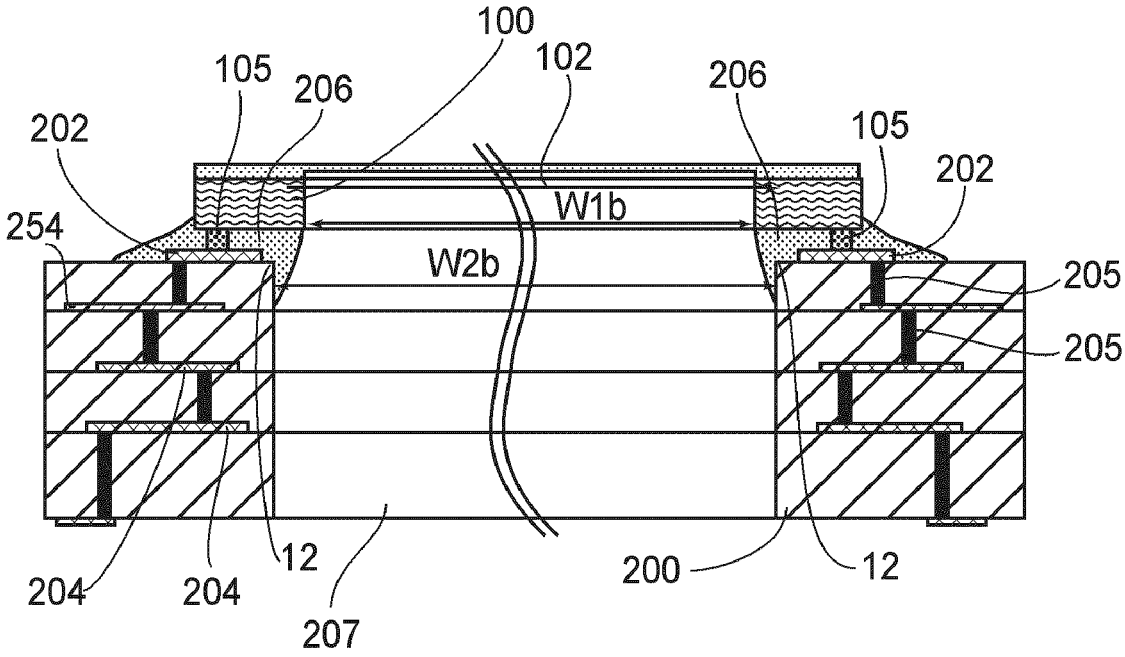

FIG. 7 is a perspective view of an outer appearance of an ink jet head according to Embodiment 2 of the present invention. FIG. 8 is a perspective view of an outer appearance of a three-dimensionally wired supporting member (a supporting member prepared by laminating ceramic sheets and forming electric wiring three-dimensionally in the ceramic sheets) shown in FIG. 7. FIG. 9 is a schematic plan view of an outer appearance showing a state in which the liquid ejection substrate of FIG. 2 is mounted on is the three-dimensionally wired supporting member of FIG. 8. FIG. 10 is a schematic sectional view, of the three-dimensionally wired supporting member in the neighborhood of an electrode for supplying driving electric power to the liquid ejection substrate, taken along D-D line in FIG. 9. FIG. 11A is a schematic sectional view taken along E-E line in FIG. 9. FIG. 11B is a schematic sectional view, of the three-dimensionally wired supporting member in the neighborhood of the liquid supply port for supplying a recording liquid to the liquid ejection substrate, taken along F-F line in FIG. 9.

The ink jet head in this embodiment includes, as shown in FIGS. 7-10, 11A and 11B, a three-dimensionally wired supporting member 200 and a liquid ejection substrate 100 mounted on the supporting member 200. Further, to the supporting member 200, a recording liquid supply member 300 is connected by an adhesive material 301 on a side opposite from the side where the liquid ejection substrate 100 is mounted.

The three-dimensionally wired supporting member 200 is, as shown in FIGS. 10, 11A and 11B, constituted by laminating a plurality of ceramic sheets. On a surface of the supporting member 200, surface electrode terminals 202 (second electrode terminals) for supplying a driving signal to the liquid ejection substrate 100 are formed. Further, on a side surface of the supporting member 200, side electrode terminals 203 for receiving an electric signal from the main assembly of the ink jet recording apparatus (FIG. 8) are formed. Further, these electrode terminals are mutually connected through internal electroconductor wiring 204 established inside the supporting member 200 and via holes 205 filled with an electroconductor. Back surface electrode terminals 111 (first electrode terminals) of the liquid ejection substrate 100 and the surface electrode terminals 202 (first electrode terminals) of the supporting member 200 are electrically connected by bumps 105. This electrical connecting portion is sealed up with a sealant 206 (or an adhesive material), thus being protected from corrosion by the recording liquid and impact.

Further, as shown in FIGS. 11A and 11B, the supporting member 200 is provided with a liquid supply hole 207 passing through the supporting member 200 from its front surface to its back surface. The recording liquid supply member 300 to be connected to the supporting member 200 is provided with a liquid supply port (not shown). As a result, the liquid supply ports and the liquid supply hole of the respective members are connected to communicate with each other, so that the recording liquid supplied from an unshown liquid supply source enters the liquid supply hole 207 of the supporting member 200 through the liquid supply port of the recording liquid supply member 300. Further, the recording liquid passes through the liquid supply port 102 of the liquid ejection substrate 100, thus being supplied to a bubble generating chamber 109 of the liquid ejection substrate 100.

As the ceramic material used for the supporting member 200, it is possible to use a chemically stable ceramic material with respect to the recording liquid. It is further preferable that the ceramic material can dissipate heat generated by the liquid ejection substrate 100 during ejection of the recording liquid. As such a ceramic material, it is possible to employ alumina, aluminum nitride, mullite, etc.

As a wiring material used for the supporting member 200, it is possible to use a material having adhesiveness to the above-described ceramic material. Examples thereof may include W, Mo, Pt, Au, Ag, Cu, Pt—Pd, etc.

The electrical connecting portion of the front surface electrode terminals 202 of the supporting member 200 and the back surface electrode terminals 111 of the liquid ejection substrate 100 are sealed up with the sealant (or the adhesive material) 206. By this, the electrical connecting portion is completely isolated from the recording liquid supplied from the liquid supply hole 207. Further, an outer periphery of the liquid supply port 102 of the liquid ejection substrate 100 is completely sealed up with the sealant 206, thus being isolated from an outside of the liquid ejection substrate 100. As a result, unnecessary leakage of the recording liquid to the outside is prevented.

In this embodiment, the connection between the back surface electrode terminals 111 of the liquid ejection substrate 100 and the front surface electrode terminals 202 of the three-dimensionally wired supporting member 200 is performed by bonding with metal bumps 15 such as gold bumps or the like. However, this bonding may also be performed by adhesive bonding using an electroconductive adhesive material or such a method that the electrodes are mutually press-contacted by a thermosetting adhesive material. The thermosetting adhesive material may also contain electroconductive particles.

In this embodiment, one liquid ejection substrate is mounted in one ink jet head and a pair of (two) ejection outlet arrays is provided in the liquid ejection substrate (FIG. 3). However, this embodiment may also be applicable to an ink jet head using a liquid ejection substrate provided with plural pairs of ejection outlet arrays.

Next, features of this embodiment will be described.

As shown in FIG. 11A and FIG. 11B, when a widthwise hole width of the liquid supply port 102 of the liquid ejection substrate 100 is W1*a*, a longitudinal hole width (hole length) of the liquid supply port 102 of the liquid ejection substrate is W1*b*, a widthwise hole width of the liquid supply hole 200 of the three-dimensionally wired supporting member 200 is W2*a*, and a longitudinal hole width (hole length) of the liquid supply hole 207 of the three-dimensionally wired supporting member 200 is Wb2, these hole widths satisfy the following relationships:

$$W1a<W2a \text{ and } W1b<W2b.$$

The liquid ejection substrate 100 is disposed on the supporting member 200 onto which a predetermined amount of the sealant 206 is applied in a predetermined position. Alternatively, after the liquid ejection substrate 100 is disposed and fixed on the supporting member 200, the sealant 206 is injected from an outer periphery of the liquid ejection substrate 100 into a gap between the liquid ejection substrate 100 and the supporting member 200, followed by hardening of the sealant 206. In either case, the sealant 206 extends between the liquid ejection substrate 100 and the supporting member 200 and reaches a portion of the liquid supply port 102 of the liquid ejection substrate 100 and a portion of the liquid supply hole 207 of the supporting member 200. For example, the widthwise hole width W1*a* of the liquid supply port 102 of the liquid ejection substrate 100 is taken as 60 μm, the longitudinal hole width W1*b* of the liquid supply port 102 of the liquid ejection substrate 100 is taken as 25 mm, the widthwise hole width W2*a* of the liquid supply hole 207 of the supporting member 200 is taken as 200 μm, and the longitudinal hole width W2*b* of the liquid supply hole 207 of the supporting member 200 is taken as 25.3 mm. In addition, when a spacing (gap) between the liquid ejection substrate 100 and the supporting member is taken as about 20 μm, a viscosity of the adhesive material 50 is taken as about 100 Pa·s, and a thixotropic ratio is taken as about 1.1, a good result is obtained. In this case, the sealant 206 extends between the liquid ejection substrate 100 and the supporting member 200 and reaches an edge line portion of the liquid supply port 102 on the liquid ejection substrate 100 side. The sealant 206 remains at the edge line portion by a meniscus force formed by the viscosity of the sealant 206 itself and the gap between the liquid ejection substrate 100 and the supporting member 200. Further, in this embodiment, an opening dimension of the liquid supply port 102 of the liquid ejection substrate 100 is smaller than that of the liquid supply hole 207 of the supporting member 200, and the edge line portion of the liquid supply port 102 extends to and reaches an inner wall of the supporting member 200 defining the liquid supply hole 207. When the sealant 206 is further injected into the gap between the liquid ejection substrate 100 and the supporting member 200, the sealant 206 on the supporting member 200 side passes through an edge line portion 12 of the liquid supply hole 207 and reaches an inner wall surface (portion) of the liquid supply hole 207. That is, the substrate 206 between the liquid ejection substrate 100 and the supporting member 200 remains while forming a meniscus connecting the liquid supply port 102 to the inner wall surface of the liquid supply hole 207. Thus, the sealant 206 on the supporting member 200 has a shape such that it covers the edge line portion 12 of the liquid supply hole 207 and the inner wall surface of the liquid supply hole 207 as shown in FIGS. 11A and 11B.

In this case, a distance from the edge line portion 12 of the liquid supply hole 207 to the front surface electrode terminal 202 for performing the connection with the bump 105 is very short. Further, the supporting member 200 is formed of a ceramic material, so that the edge line portion 12 of the liquid supply hole 207 is liable to cause an edge defect portion.

However, in this embodiment, similarly as in Embodiment 1, the edge defect portion of the edge line portion 12 of the liquid supply hole 207 of the supporting member 200 can be completely covered with the sealant 206. As a result, an adhesive area in the neighborhood of the liquid supply hole 207 of the supporting member 200 is not narrowed and the inner wall surface of the liquid supply hole 207 is also used as the adhesive area, so that a sufficient adhesive area can be obtained. In the case where the liquid ejection substrate 100 is narrowed and downsized, the distance between the edge line portion 12 of the liquid supply hole 207 and the front surface electrode terminal 202 is extremely short, but in this embodiment, it is possible to ensure a sufficient adhesive area thereby to obtain high adhesive reliability.

Figure 12A:
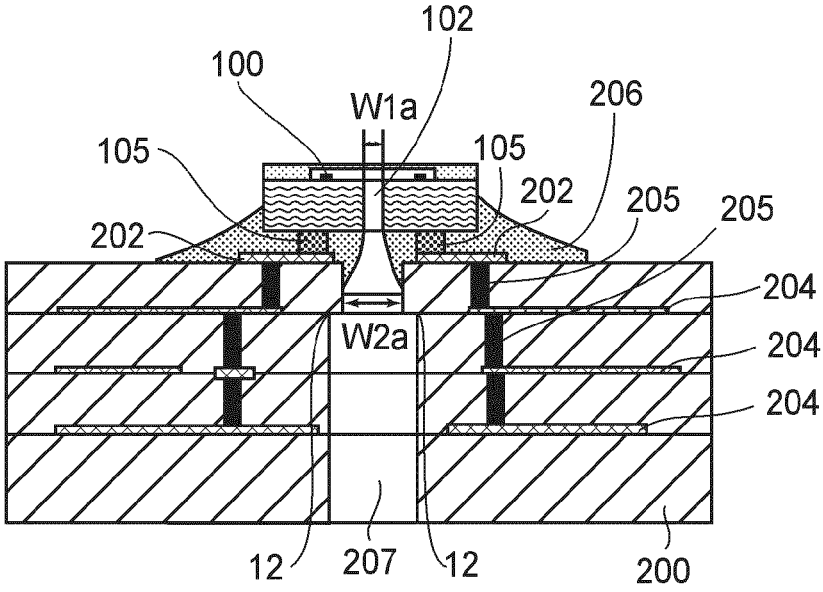
Figure 12B:
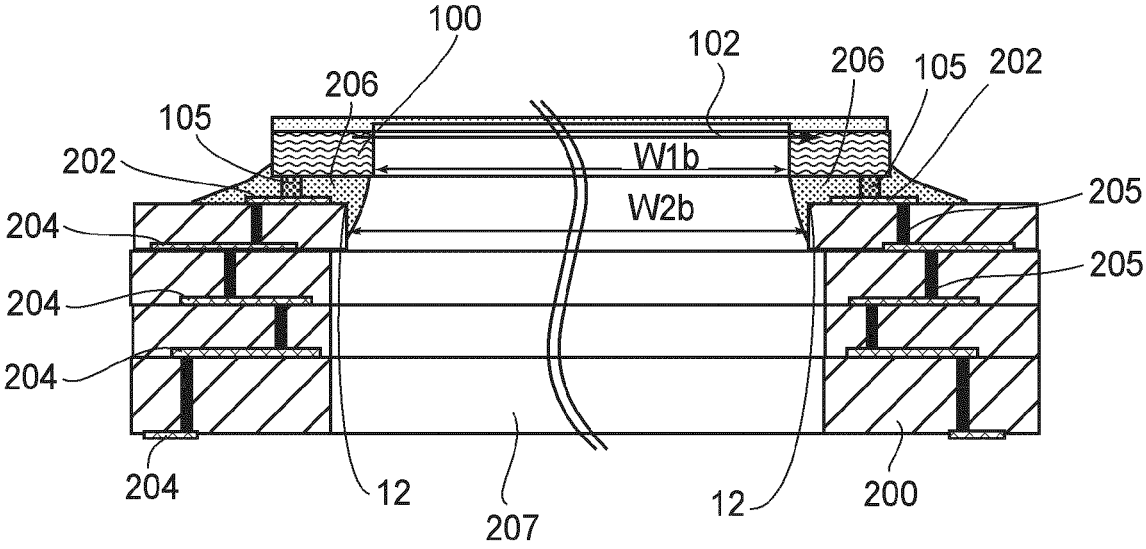

Further, as shown in FIGS. 12A and 12B, widthwise and longitudinal hole widths of second, third and fourth layers (ceramic sheets) may be larger than the widthwise hole width W2*a* and the longitudinal hole width W2*b* of an uppermost (first) layer (ceramic sheet) of the supporting member 200, respectively. In this case, similarly as in the case described with reference to FIGS. 11A and 11B, the inner wall surface of the liquid supply hole 207 of the uppermost layer can be covered with the sealant 206. Further, in this case, the hole widths of the liquid supply hole of the uppermost layer and the second layer immediately under the uppermost layer are different from each other to form a stepped portion, so that it is possible to block the sealant 206 moved along the inner wall surface of the liquid supply hole 207 at the stepped portion by the meniscus force. Therefore, it is possible to cover the inner wall surface of the liquid supply hole 207 with the sealant 206 with reliability.

Figure 13:
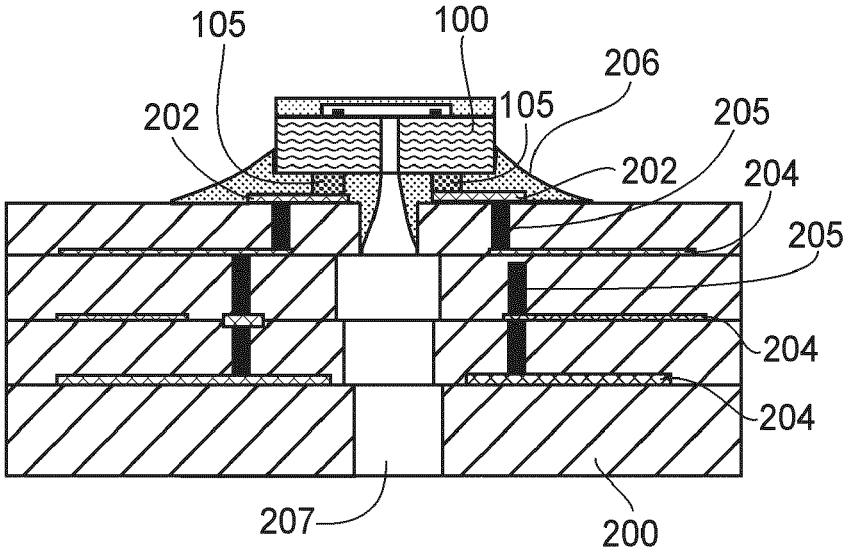
Figure 14A:
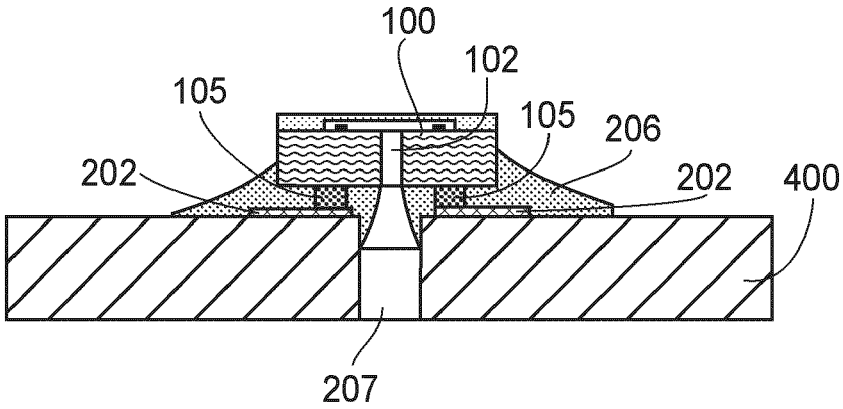
Figure 14B:
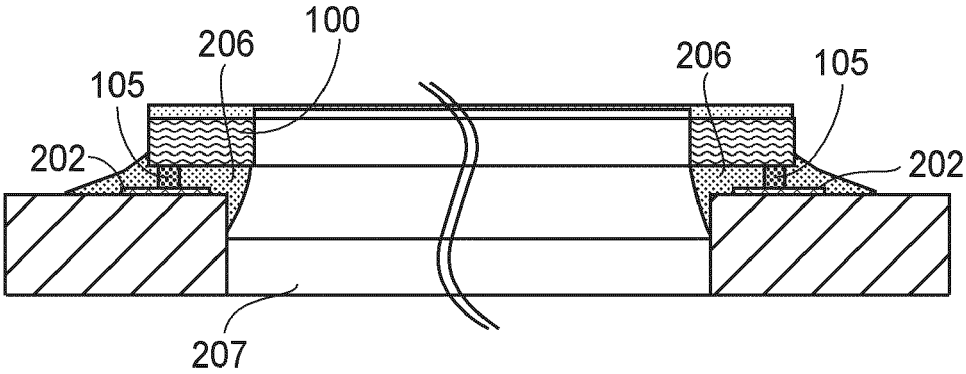

In this embodiment, as shown in FIG. 13, with respect to the liquid supply hole 207 of the respective (first to fourth) layers constituting the supporting member 200, when the hole width of the second layer is larger than that of the first (uppermost) layer, it is possible to freely set the hole widths of the third and fourth layers.

Further, the present invention is also applicable to such a constitution in which front surface electrode terminals 202 are formed on the surface of a single supporting member 400, not the laminated-structured supporting member, to which a liquid ejection substrate 100 is connected through bumps 105.

Embodiment 3

Figure 17A:
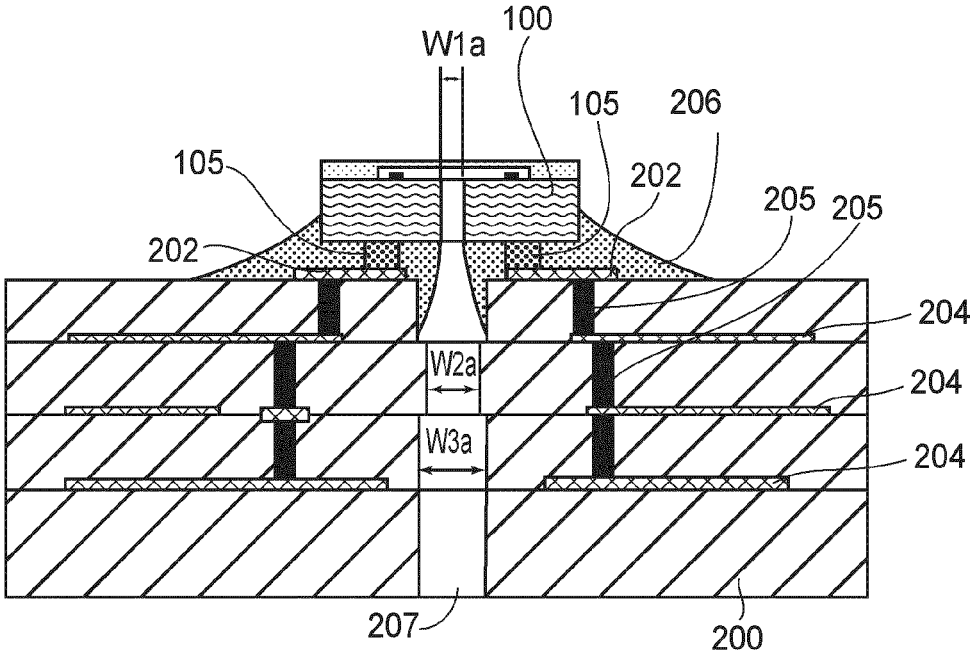
Figure 17B:
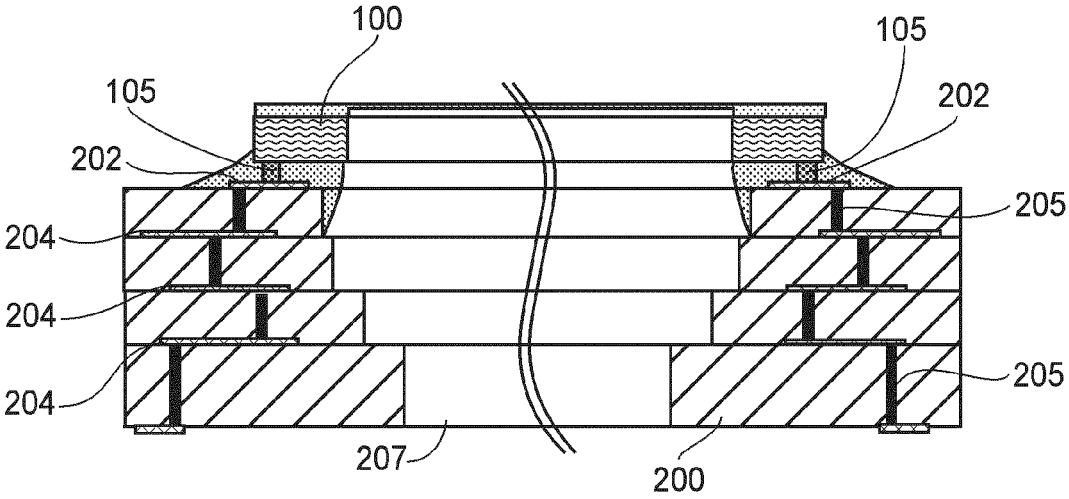
Figure 18:
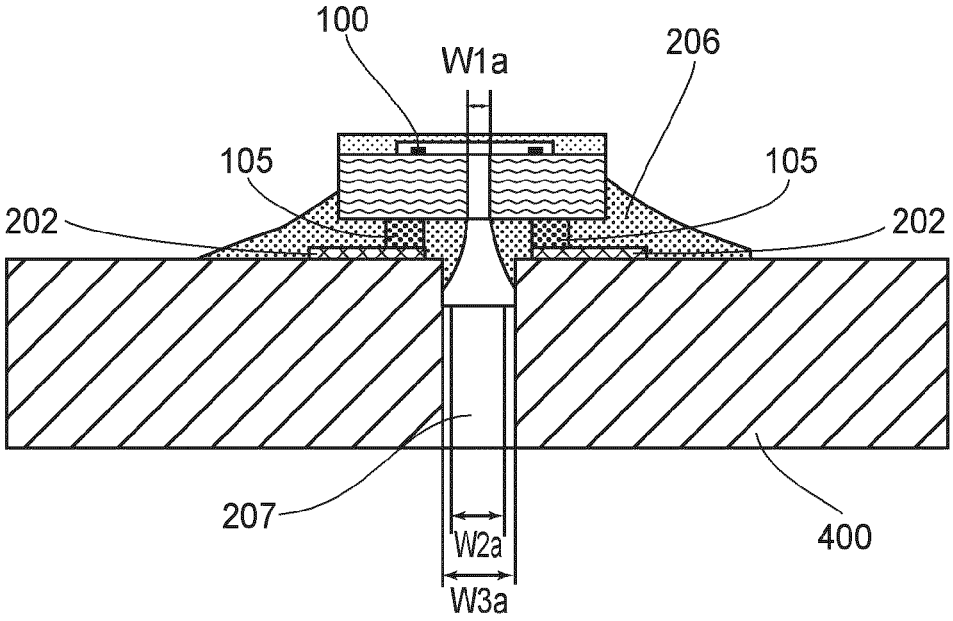
Figure 19:
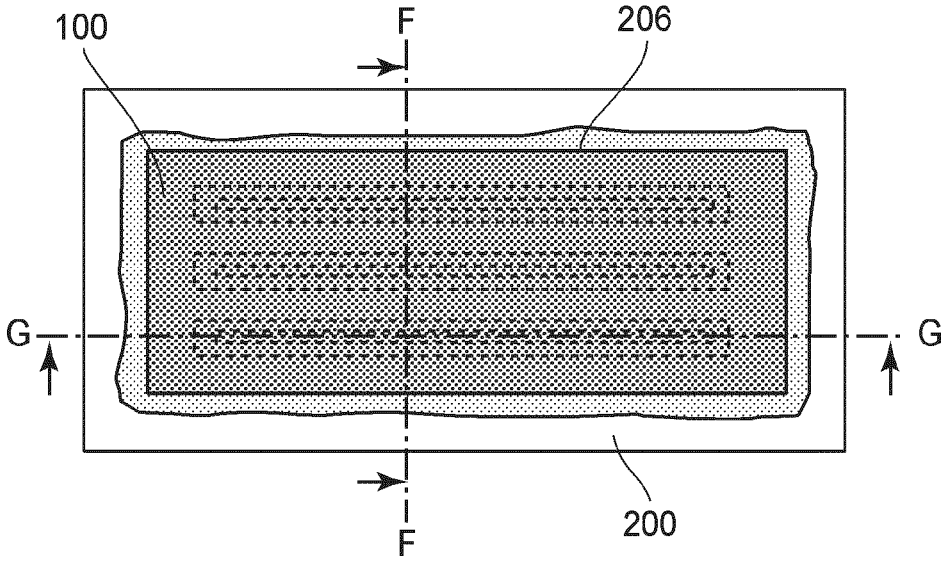
FIG. 19 is a plan view of an outer appearance showing a state in which a liquid ejection substrate having a plurality of liquid supply ports is mounted on a supporting member in Embodiment 3 of the present invention.

FIGS. 15 to 20 are schematic views each for illustrating an ink jet head in Embodiment 3 according is to the present invention, wherein FIGS. 15A, 15B, 16, 17A, 17B, 18, 20A and 20B are sectional views showing a portion in the neighborhood of a liquid supply port for supplying a recording liquid to a liquid ejection substrate 100 and FIG. 19 is a plan view thereof.

In Embodiment 2 described above, the liquid supply hole 207 of the supporting member is increased in hole width compared with the liquid supply port 102 of the liquid ejection substrate 100. Further, the uppermost layer of the supporting member 200, i.e., the inner wall surface of the liquid supply hole 207 containing the edge line portion of the liquid supply hole 207 with respect to the supporting surface for the liquid ejection substrate 100 is covered with the sealant 206. These constitutions are similarly employed in this embodiment. However, in this embodiment, hole widths of the liquid supply hole 207 of the second layer contacting the uppermost (first) layer are smaller than those of the liquid supply hole 207 of the uppermost layer constituting the supporting member 200.

Figure 15A:
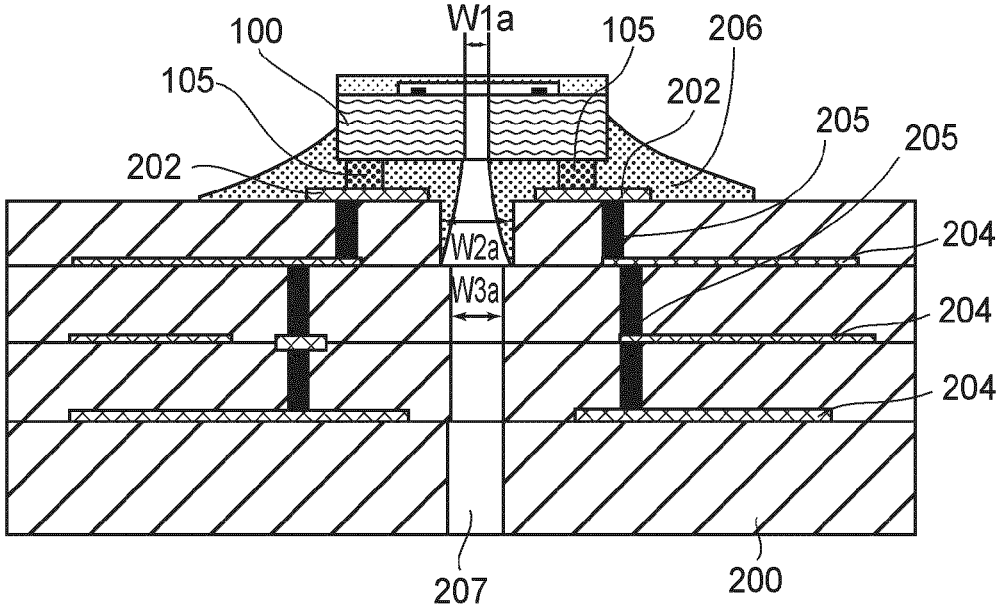

As shown in FIG. 15A, when a widthwise hole width of the liquid supply port 102 of the liquid ejection substrate 100 is W1*a*, a widthwise hole width of the liquid supply hole 207 of the uppermost layer constituting the supporting member 200 is W2*a*, and a widthwise hole width of the liquid supply hole 207 of the second layer constituting the supporting member 200 is W3*a*, the following two relationships are satisfied:

$$W1a<W2a \text{ and } W2a>W3a.$$

By satisfying these relationships, an effect similar to those in Embodiments 1 and 2 described above is achieved. In this embodiment, as shown in FIG. 15A to FIG. 17B, the sealant 206 covers the edge line portion 12 of the liquid supply hole 207 of the three-dimensionally wired supporting member 200 and enters the liquid supply hole 207 along the inner wall surface of the liquid supply hole 207 of the uppermost layer constituting the supporting member 200. The sealant 206 stops at a portion (upper surface of the second layer) where the hole width of the liquid supply hole 207 (an opening width of the supporting member 200) is changed. For that reason, the sealant 206 can have a good shape capable of completely covering the edge line portion 12 of the liquid supply hole 207 and the inner wall surface of the uppermost layer constituting the supporting member 200.

Figure 15B:
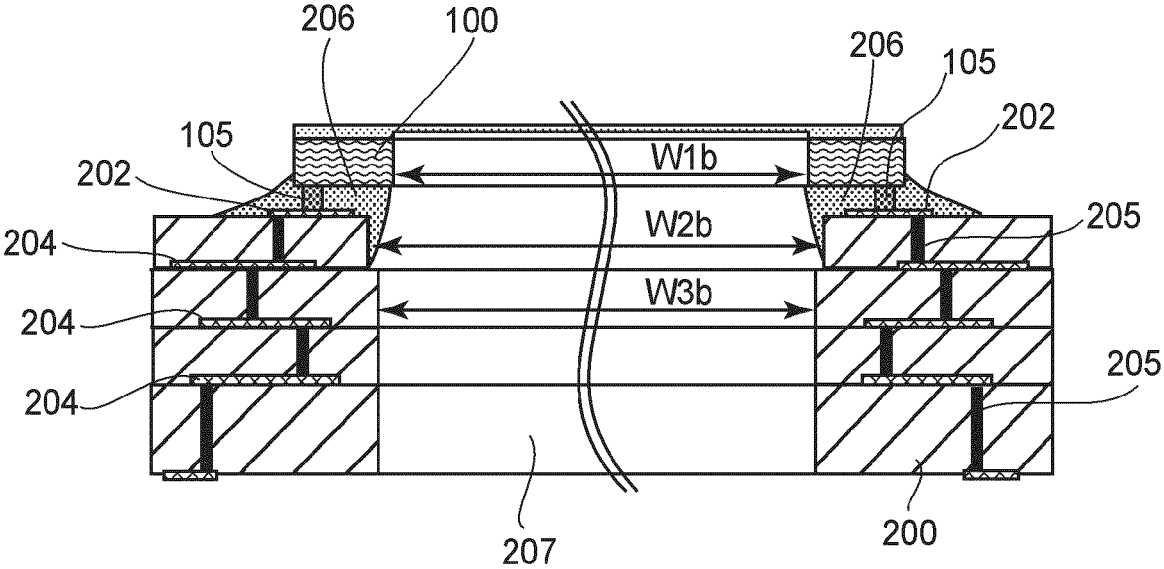
Figure 16:
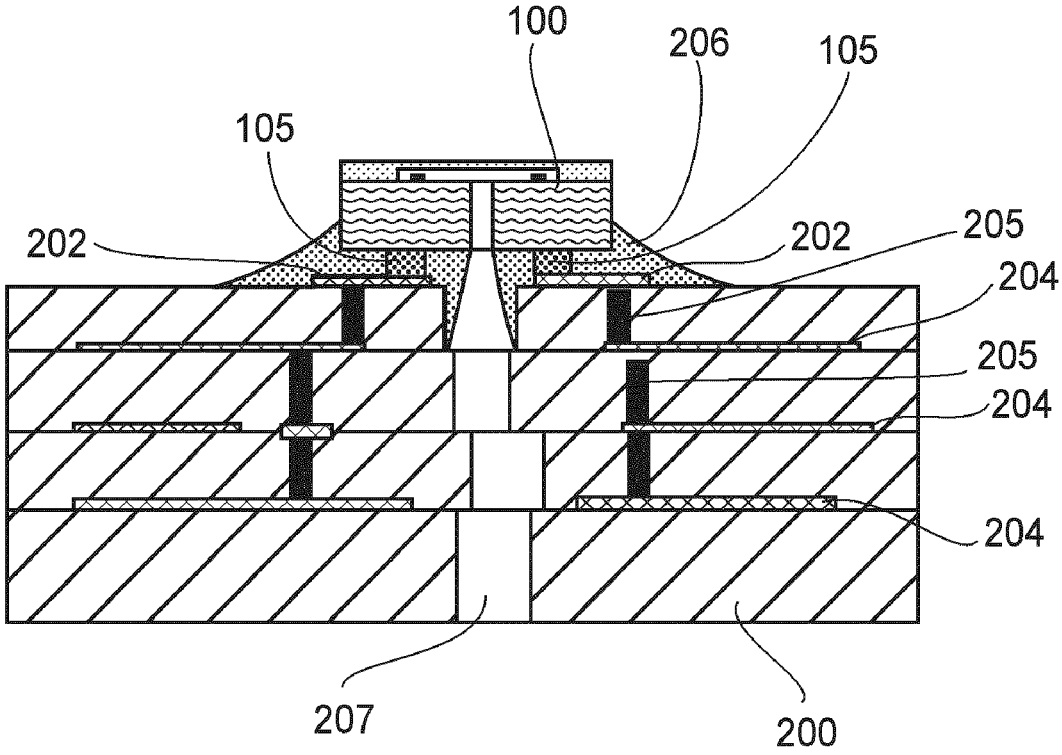

With respect to the hole widths of the liquid supply hole 207 of the supporting member 200, as shown in FIGS. 15A and 15B, when hole widths W3*a* and W3*b* of the liquid supply hole 207 of the second layer are smaller than hole widths W2*a* and W2*b* of the liquid supply hole 207 of the uppermost layer, respectively, hole widths of the third and fourth layers can be set freely. For example, as shown in FIG. 16, the liquid supply holes 207 of the third and fourth layers may be deviated from the upper liquid supply hole in a widthwise direction.

Figure 20A:
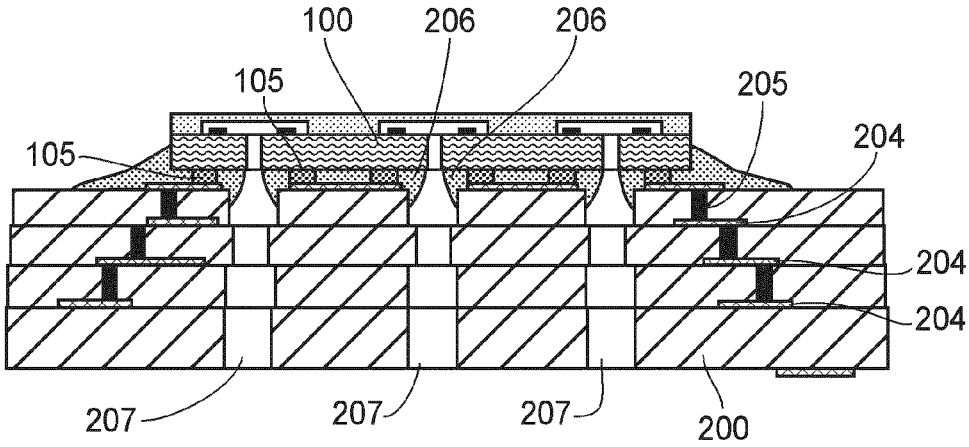
Figure 20B:
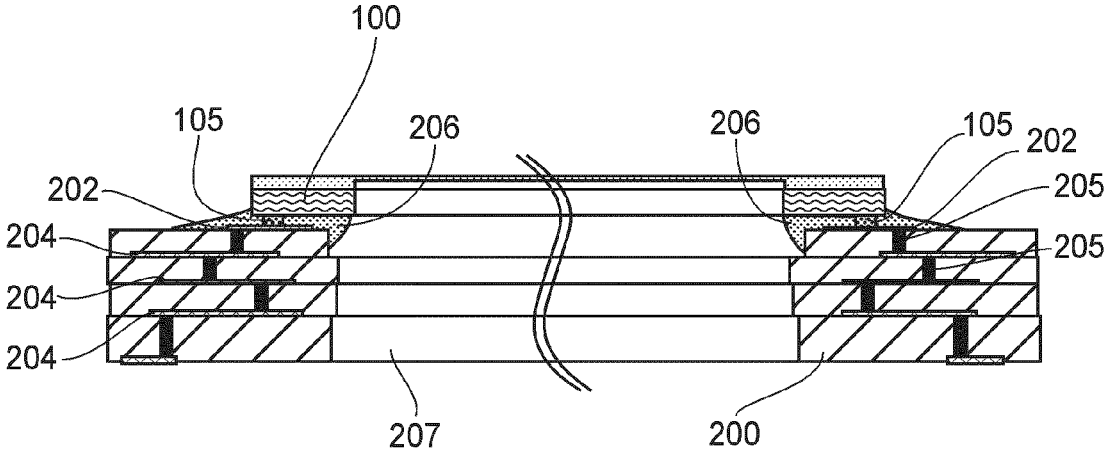

Further, as shown in FIGS. 17A and 17B, the hole widths of the liquid supply hole 207 of the second layer are smaller than those of the liquid supply hole 207 of the uppermost layer. In this case, the widthwise hole width of the third layer may be larger than that of the second layer and the longitudinal hole width of the third layer may be smaller than that of the second layer. Further, the widthwise hole width of the fourth layer may be identical to that of the third layer and the longitudinal hole width of the fourth layer may be smaller than that of the third layer. By forming the liquid supply hole 207 in such a shape, it is possible to improve a supply performance of liquid to the liquid ejection substrate 100. Further, it is also possible to employ such a constitution that front surface electrode terminals 202 are formed on the surface of the supporting member 400 and the liquid ejection substrate 100 is connected to the electrode terminals 202 through the bumps 105 as shown in FIG. 18. Further, as shown in FIGS. 19, 20A and 20B, it is also possible to employ such a constitution that a plurality of liquid supply ports is provided in a single liquid ejection substrate 100.

In any of the above-described constitutions, it was possible to sufficiently ensure reliability of adhesive sealing between the liquid ejection substrate and the supporting member.

Other Embodiments

A liquid ejection recording apparatus (ink jet recording apparatus) capable of mounting the ink jet head according to the present invention will be described.

Figure 21:
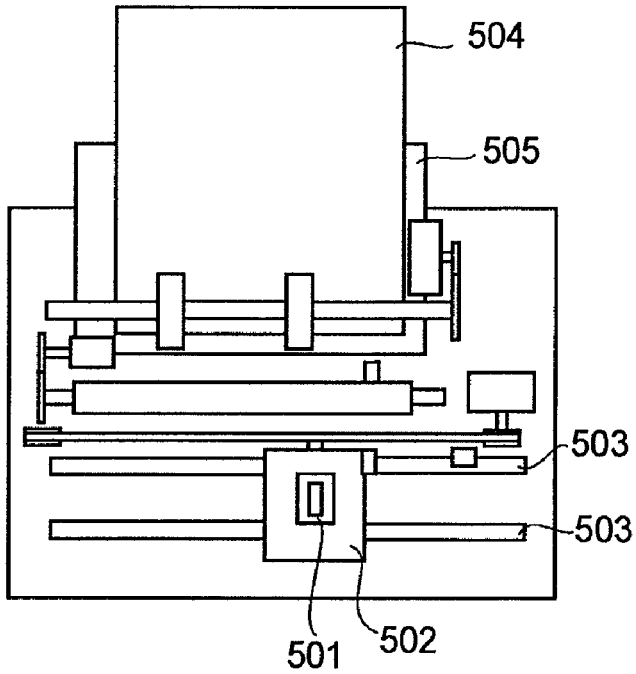
FIG. 21 is a schematic view for illustrating an embodiment of a recording apparatus capable of mounting an ink jet head according to the present invention.
Figure 22:
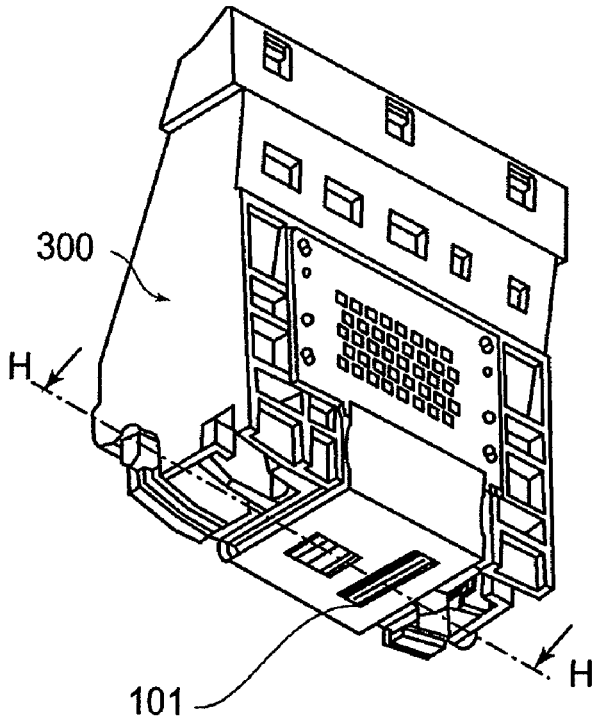
FIG.22 PRIOR ART
FIG. 22 is a perspective view of an outer appearance of a conventional ink jet head.
Figure 23:
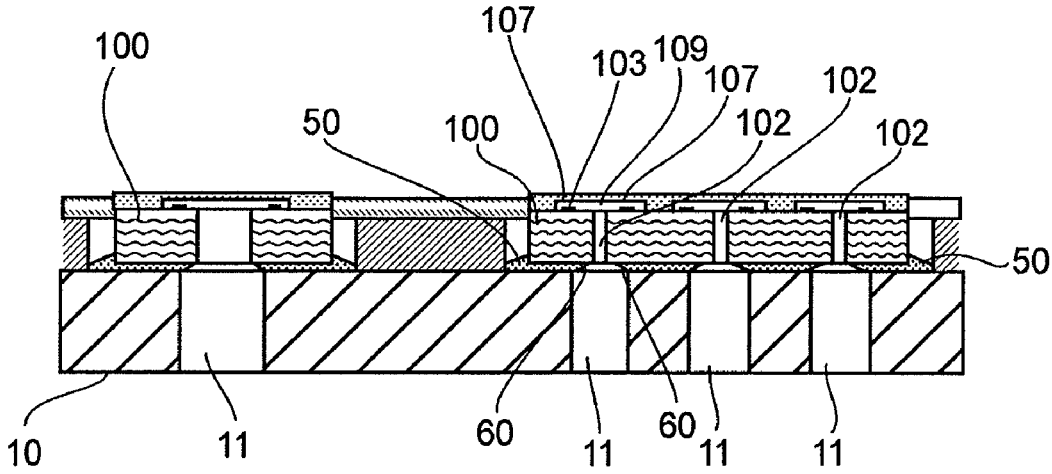
FIG.23 PRIOR ART
FIG. 23 is a schematic sectional view taken along H-H line in FIG. 22.
Figure 24:
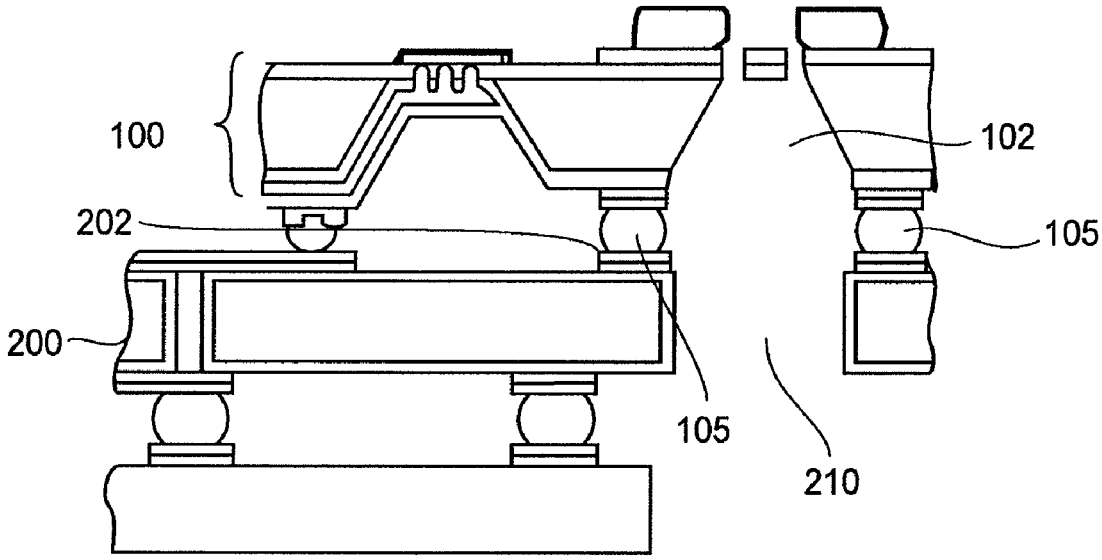
FIG.24 PRIOR ART
FIG. 24 is a schematic sectional view showing a structure of another conventional ink jet head.
Figure 25A:
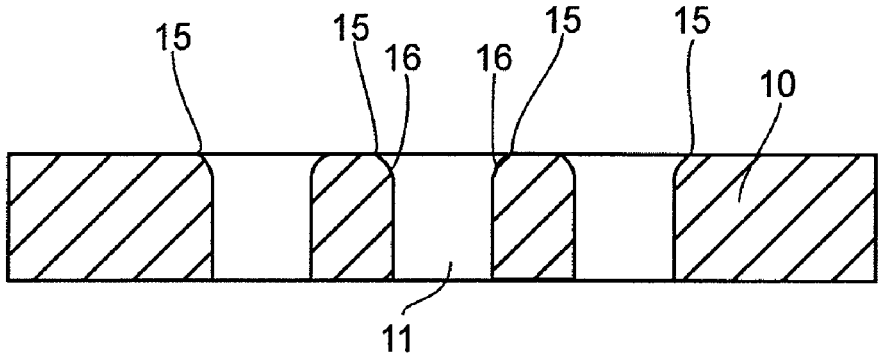
FIG.25A PRIOR ART
FIGS. 25A and 25B are schematic sectional views each showing a state of a liquid supply hole of a supporting member for a conventional ink jet head.
Figure 25B:
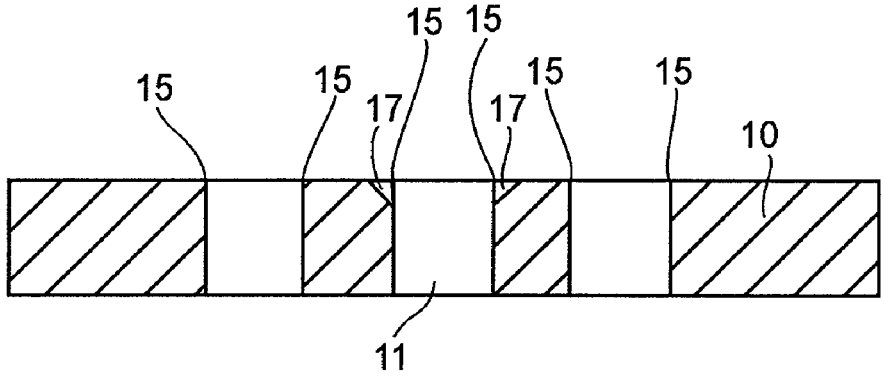
FIG.25B PRIOR ART
Figure 26:
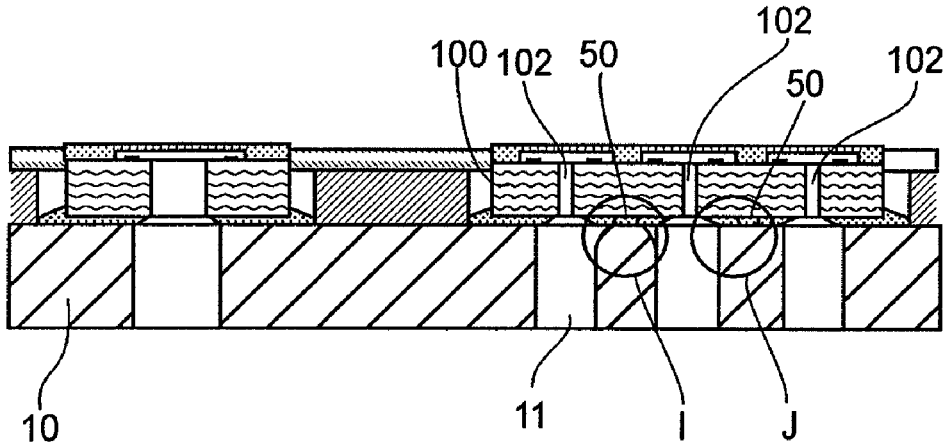
FIG.26 PRIOR ART
FIG. 26 is a schematic sectional view showing a connection structure of a liquid ejection substrate and a supporting member in a conventional ink jet head.

FIG. 21 is a schematic view for illustrating an embodiment of the recording apparatus capable of mounting the ink jet head of the present invention.

In the recording apparatus shown in FIG. 21, an ink jet head 501 according to the above-described embodiments is positioned and replaceably mounted on a carriage 502. To the carriage 502, an electrical connecting portion (not shown) for sending a driving signal and the like to each of ejection outlet arrays through an electrical connecting portion on the ink jet head 501 is attached.

The carriage 502 extends in a main scan direction and is reciprocably guided and supported along a guide shaft 503 mounted in a main assembly of the recording apparatus.

In a home position of the carriage 502, a cap is (not shown) for capping a front surface of the ink jet head 501, where ink ejection outlets are formed, is disposed. The cap is used for effecting suction refreshing for retaining and refreshing an ink ejection performance of the ink jet head 501. In the neighborhood of the cap, a cleaning blade (not shown) for removing ink or the like deposited on a surface at which ink ejection outlets 107 of a liquid ejection substrate 100 are opened by rubbing the surface is provided.

A recording medium 504 such as a recording sheet or a plastic thin film is separated and fed from an automatic sheet feeder (ASF) one by one and is passed through a (recording) position opposite to an ejection outlet surface of the ink jet head 501 to be conveyed (subjected to sub-scanning).

The recording medium 504 is held in the recording position by two sets of conveyance roller pairs disposed upstream and downstream from the recording position with respect to the conveyance direction so that it faces the ejection outlets of the ink jet head 501.

The ink jet head 501 is mounted on the carriage 502 so that an arrangement direction of the ejection outlets in each of ejection outlet arrays is perpendicular to the above described scanning direction of the carriage 502, and ejects liquid from is these ejection outlet arrays to effect recording.

In the above described embodiments, in order to eject the ink by utilizing heat energy, the electrothermal transducer elements for generating heat energy are used, but to the present invention, other ejection methods including ejection of ink with vibration elements or the like are also applicable.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 168893/2007 filed Jun. 27, 2007, which is hereby incorporated by reference herein.

What is claimed is:

1. A liquid ejection head comprising:

a liquid ejection substrate comprising a liquid supply port for supplying liquid, an ejection outlet for ejecting the liquid supplied from the liquid supply port, and ejection energy generating means for generating energy for ejecting the liquid; and a supporting member having a supporting surface for supporting said liquid ejection substrate and a liquid supply hole for supplying liquid to said liquid ejection substrate, the liquid supply hole communicating with the liquid supply port of said liquid ejection substrate to form a communicating portion, a periphery of which is sealed by a sealant, wherein the liquid supply hole of said supporting member has an opening larger than that of the liquid supply port of said liquid ejection substrate, wherein said supporting member has an inner wall portion including an edge line portion defined by the liquid supply hole on a side where said liquid ejection substrate is to be disposed, the edge line portion being covered with the sealant, wherein said liquid ejection substrate is provided with an electrode on a surface facing the supporting surface of said supporting member, and wherein said supporting member is provided with an electrode, on the supporting surface, connected to the electrode of said liquid ejection substrate by an electrical connecting member.

2. A liquid ejection head comprising:

a liquid ejection substrate comprising a liquid supply port for supplying liquid, an ejection outlet for ejecting the liquid supplied from the liquid supply port, and ejection energy generating means for generating energy for ejecting the liquid; and a supporting member having a supporting surface for supporting said liquid ejection substrate and a liquid supply hole for supplying liquid to said liquid ejection substrate, the liquid supply hole communicating with the liquid supply port of said liquid ejection substrate to form a communicating portion, a periphery of which is sealed by a sealant, wherein the liquid supply hole of said supporting member has an opening larger than that of the liquid supply port of said liquid ejection substrate, wherein said supporting member has an inner wall portion including an edge line portion defined by the liquid supply hole on a side where said liquid ejection substrate is to be disposed, the edge line portion being covered with the sealant, and wherein the liquid supply port of said liquid ejection substrate is provided with an edge line portion located inside the liquid supply hole of said supporting member on a side where said liquid ejection substrate is disposed.

* * * * *